US012270158B2

(12) United States Patent
Holden

(10) Patent No.: US 12,270,158 B2
(45) Date of Patent: Apr. 8, 2025

(54) LIGHT RAILWAY SYSTEM

(71) Applicant: Carpet Track Ltd, Stourbridge (GB)

(72) Inventor: Christopher Holden, Forres (GB)

(73) Assignee: CARPET TRACK LTD (GB)

( * ) Notice: Subject to any disclaimer, the term of this patent is extended or adjusted under 35 U.S.C. 154(b) by 655 days.

(21) Appl. No.: 17/634,198

(22) PCT Filed: Aug. 7, 2020

(86) PCT No.: PCT/GB2020/051897

§ 371 (c)(1),
(2) Date: Feb. 9, 2022

(87) PCT Pub. No.: WO2021/028668

PCT Pub. Date: Feb. 18, 2021

(65) Prior Publication Data

US 2022/0316143 A1 Oct. 6, 2022

(30) Foreign Application Priority Data

Aug. 9, 2019 (GB) ..... 1911439

(51) Int. Cl.
*E01B 21/04* (2006.01)
*E01B 3/22* (2006.01)

(52) U.S. Cl.
CPC ..... *E01B 21/04* (2013.01); *E01B 3/22* (2013.01)

(58) Field of Classification Search
CPC . E01B 21/00; E01B 21/04; E01B 3/22; E01B 7/08
See application file for complete search history.

(56) References Cited

U.S. PATENT DOCUMENTS 5,036,773 A * 8/1991 Christen ..... E01B 25/12 104/130.05
7,975,932 B2 * 7/2011 Graf von der Schulenburg-Wolfsburg ..... E01B 1/002 238/7
9,938,713 B1 * 4/2018 Ertl ..... E04B 2/50
(Continued)

FOREIGN PATENT DOCUMENTS

CA 2592757 C * 12/2010 ..... E01B 1/004
CN 107758254 3/2018
(Continued)

OTHER PUBLICATIONS

UK Search Report for Application No. GB1911439.6 dated Feb. 10, 2020.

(Continued)

*Primary Examiner* — Jason C Smith

(57) ABSTRACT

A light railway system comprising two parallel rails (12) each having a base portion (14) with a flat bottom, an upward-extending web (15), and a railhead (16), and resting within a respective trough structure (20). The trough structure (20) comprising multiple trough units (22) arranged end to end, with blocks (24, 26) that fit between the web (15) of the rail (12) and side portions of the trough unit (22) so as to locate the rail (12) within the trough structure (20). The system also includes multiple spaced-apart rigid ties (28) that interconnect the trough structures (20), so the rails (12) are at a desired separation. Inserted junction plates (54) may be used to hold successive trough units (22) in alignment.

16 Claims, 8 Drawing Sheets

(56) References Cited

U.S. PATENT DOCUMENTS

| | | | | |
|---|---|---|---|---|
| 2018/0148896 | A1* | 5/2018 | Vian | E01B 29/04 |
| 2022/0316143 | A1* | 10/2022 | Holden | E01B 21/04 |

FOREIGN PATENT DOCUMENTS

| | | | | | |
|---|---|---|---|---|---|
| CN | 117604834 | A | * | 2/2024 | |
| EP | 0387188 | | | 9/1990 | |
| EP | 0387188 | A1 | * | 9/1990 | |
| EP | 2819904 | B1 | * | 11/2018 | B61D 1/00 |
| FR | 2711683 | A1 | * | 5/1995 | E01B 7/08 |
| FR | 2711683 | | | 1/1996 | |
| JP | 2010037753 | | | 2/2010 | |
| KR | 20120102874 | A | * | 9/2012 | |
| KR | 20140028939 | A | * | 3/2014 | |
| KR | 20150064004 | A | * | 6/2015 | |
| KR | 20160017999 | A | * | 2/2016 | |
| KR | 20180016726 | A | * | 2/2018 | |
| WO | 0123669 | | | 4/2001 | |
| WO | WO-0123669 | A1 | * | 4/2001 | E01B 1/004 |
| WO | 03016629 | | | 2/2003 | |

OTHER PUBLICATIONS

UK Search Report for Application No. GB1911439.6 dated Sep. 18, 2020.

International Search Report and Written Opinion for Application No. PCT/GB2020/051897 dated Oct. 26, 2020.

* cited by examiner

LIGHT RAILWAY SYSTEM

The present invention relates to a light railway system, for example a tram system.

Technology as currently used for installing rails for trams involves a considerable amount of excavation. Where a tram route is to run along a road this will require excavation of the road surface to a significant depth, with the laying of a concrete foundation the full width of the track, on which sleepers are then mounted to carry the rails. Furthermore tram systems often use a special-purpose rail which defines a deep groove to accommodate wheel flanges; this rail is more expensive than the type of rail used on conventional railways. A less expensive way of installing a light railway system would be advantageous.

According to a first aspect of the present invention there is provided a light railway system comprising two parallel rails, each rail having a base portion with a flat bottom, an upward-extending web, and a railhead, and resting within a respective trough structure comprising multiple trough units arranged end to end, with blocks that fit between the web of the rail and side portions of the trough unit so as to locate the rail within the trough structure, and the system also including multiple spaced-apart rigid ties that interconnect the trough structures, to hold the trough structures and so the rails at a desired separation.

Thus each rail is located in a respective trough structure. The two parallel rails are in two separate but parallel trough structures, and the two trough structures are held together by rigid ties. The trough units may comprise an outer generally-rectangular and open-topped first trough element, defining side walls and a base, and a second trough element that defines a recess to locate the rail and the blocks, and that defines edge flanges fixed to the top edges of the side walls of the first trough element, the base of the recess being supported by the base of the first trough element. The recess must have a flat bottom on which the rail can rest, and has side walls that may be at least partly arcuate.

The blocks locate the rail within the trough structure, and so must be rigid enough to achieve this. They may be of a rigid and hard-wearing wood such as oak, or a similarly rigid engineering plastic or composite material, or may be of a metal; if they are of a metal the blocks may be hollow, as long as they are sufficiently rigid. Each block must be of a size that can be conveniently inserted into position, and so would typically be of a length between 0.1 m and 2 m, for example 0.3 m or 0.5 m. The rail is located by the blocks, one on either side; no other items are required to hold the rail in position in the trough structure.

The blocks may not extend to the top of the recess, and there may also be resilient locking elements that extend between the tops of the blocks and the top of the recess. The arrangement may be such that the top surfaces of the edge flanges of the trough units, and of the rail, and of the resilient locking elements are substantially in a common plane. There must however be a gap between one side of the railhead and the adjacent edge flange of the trough unit for the wheel flanges when a tram passes along the rails; and the resilient locking element on that side of the railhead may be a compressible tube. For safety and security there are preferable no significant gaps between successive blocks along the length of the trough structure.

The blocks may be secured in position by their own weight, and where there are resilient locking elements these may also secure the blocks in position. The blocks may also be secured by other removable fastening devices, such as bolts, or spring clips, At least one of the blocks, and the adjacent side wall, may be shaped such that the block can be rotated into position after the block on the other side has been inserted.

Each end of each trough unit may be linked to the next trough unit by one or more projections and mating recesses, so the successive trough units are held securely in alignment with each other. For example the side walls of each first trough element may define recesses at each end, so a joining element may be inserted into the opposed recesses on successive trough units. In one example the side walls incorporate two parallel spaced-apart bearer strips whose opposed edges are bevelled so the gap between the edges becomes narrower going away from the side wall; a rectangular junction plate whose edges have mating bevels can then be inserted between the bearer strips on the adjacent trough units, to hold the adjacent trough units in alignment. To ensure the correct positioning of the junction plate, so the junction plate does not engage too far with one of the trough units, the bearer strips are bevelled only along a portion of their length, and there is a non-bevelled portion further from the end of the trough unit that prevents further insertion of the junction plate.

The rigid ties that interconnect the trough structures may comprise a bar or rod with two spaced apart projections at each end, the two projections being spaced apart by a distance equal to the thickness of the side wall of the trough unit, and at least the projection nearest the end of the bar or rod being shaped like the cross of a T, i.e. in the shape of a short bar or rod orthogonal to the aforementioned bar or rod. In this case the side wall of each trough unit defines a slot through which the end projection can be inserted, and the bar or rod can then be turned through 90° so the two projections engage with opposite faces of the side wall. Preferably both the projections are shaped like the cross of a T, and in use the bar or rod would be inserted into a slot of the trough structure at one side of the track, being inserted beyond the desired position, so it can then be inserted into a slot of the trough structure at the opposite side of the track and partially withdrawn from the first slot, so at the two ends of the bar or rod the two projections engage with the two trough structures. The bar or rod may be of a fixed length, and this is appropriate where the track is straight. Alternatively the bar or rod may include a length adjustment mechanism, for example having two parts joined by a turnbuckle, the turnbuckle having a left-hand thread at one end and a right-hand thread at the other end. This may be advantageous where adjustment to the gauge is required on sharp curves.

Each trough unit may for example be of length between 1 m and 3 m, and may be made of steel plates. The steel plates provide rigidity to the system, and may for example be of thickness between 4 mm and 10 mm, for example 6 mm. Where additional strength is required, two plates may be bonded together, for example there may be two plates that form the base of the first trough element, and there may be a reinforcement plate in the side walls of the first trough element, at least in the position of the slot that locates the projections of the rigid ties. It will be appreciated that the height of the trough unit is determined by the height of the rail, if the top of the railhead is to be in substantially the same plane as the top surface of the trough unit. The width of the trough unit depends on the required separation of the rails, which would normally be the standard gauge of 4' 8½"=56.5" (1435 mm), and on the desired width of the gap between the trough units on either side of the track. It may for example be between 250 mm and 500 mm.

In a second aspect the invention provides a turnout or points mechanism suitable for use in a light rail system, the mechanism comprising two generally horizontal cylindrical support tubes, each open along an upper face, and each locating a beam having at least two faces, and supported by bearings within the support tube such that a first face of the beam may be exposed at the open upper face of the support tube, the bearings enabling the beam to be turned around its longitudinal axis so as to expose a second face, wherein the first face of the beam defines a groove forming a first flangeway from one end of the beam to the other, and the second face of the beam defines a groove forming a second flangeway from one end of the beam to the other.

The first and second flangeways define the two alternative paths for the rail vehicle to follow. Turning the two beams to change the exposed faces therefore changes the path followed by the rail vehicle. The bearings may be rollers, for example ceramic rollers. The beam may be of a solid hard wearing material; or may be of a solid material such as an engineering plastic material, with a hard-wearing metal plate on at least the faces that define the flangeways. The beam may be of generally square cross-section, and the first and second faces may be adjacent faces. The beam may instead be cylindrical but with two flat faces.

The points mechanism preferably also incorporates a drive mechanism, arranged to turn both the beams at the same time. This may for example utilise a sector gear plate mounted on the beam, for example on an end or end plate of the beam, and engaging a worm drive. The worm drives for the two beams may be driven by the same driveshaft. The driveshaft may be driven by an electric motor.

The mechanism may also include a manual drive, so that if necessary the tram operator can change the setting of the points mechanism. The manual drive desirably makes use of the same driveshaft.

By way of example, to achieve a curve of radius 25 m, each beam may be of length 3.53 m and of width between 310 mm and 470 mm, and preferably of width 410 mm.

It will be appreciated that the points mechanism of the second aspect of the invention may be used in conjunction with the light railway system of the first aspect of the invention. Each cylindrical support tube may be mounted within a respective points trough unit which can be connected to trough units as described above. At the running-on end of the points mechanism the points trough unit would be connected to a single trough unit such that the rail of the trough unit aligns with the flangeway whichever face is exposed. At the running-off end of the points mechanism each points trough might be connected to two side-by-side trough units, with the rails of the side-by-side trough units aligning respectively with one or other of the flangeways, but more preferably is connected to a modified trough unit which carries two diverging rails.

Beyond the points the track becomes two separate tracks, and it will be appreciated that the right-hand rail of the left-hand track will intersect the left-hand rail of the right-hand track. At this position a frog device is required. This may consist of a beam one face of which defines two grooves acting as flangeways, which intersect to form an X. One such flangeway may be straight and the other curved, for example.

The invention will now be further and more particularly described, by way of example only, and with reference to the accompanying drawings in which.

Figure 3A:
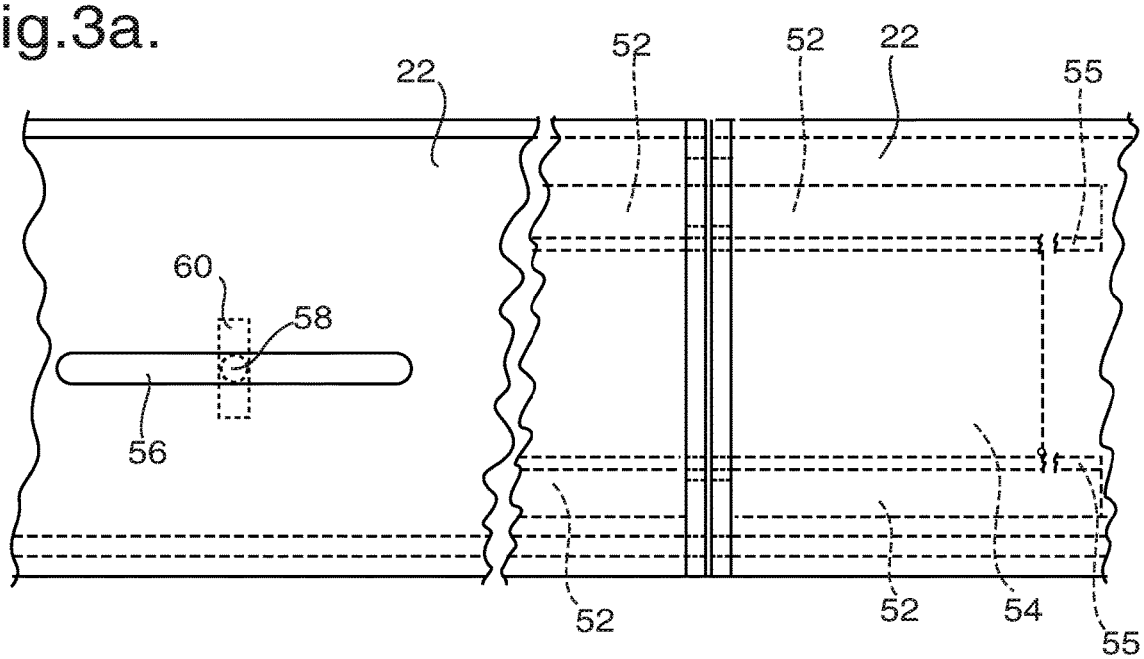
Figure 3B:
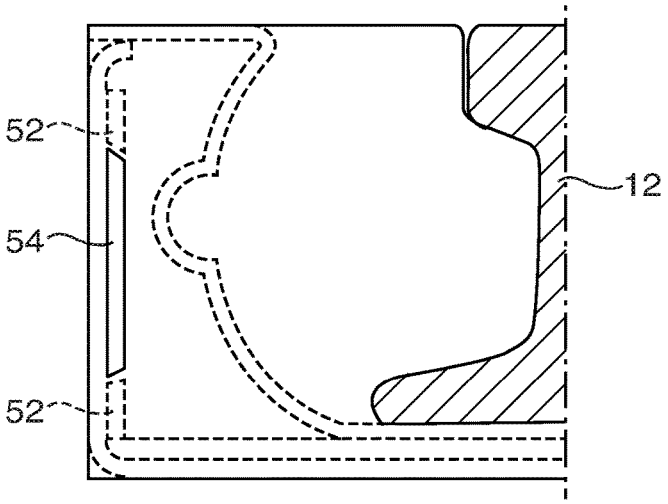

FIG. 3*a* shows a side view of two trough units joined together;

FIG. 3*b* shows a schematic half-section view of the join between the two trough units of FIG. 3*a;*

Figure 1:
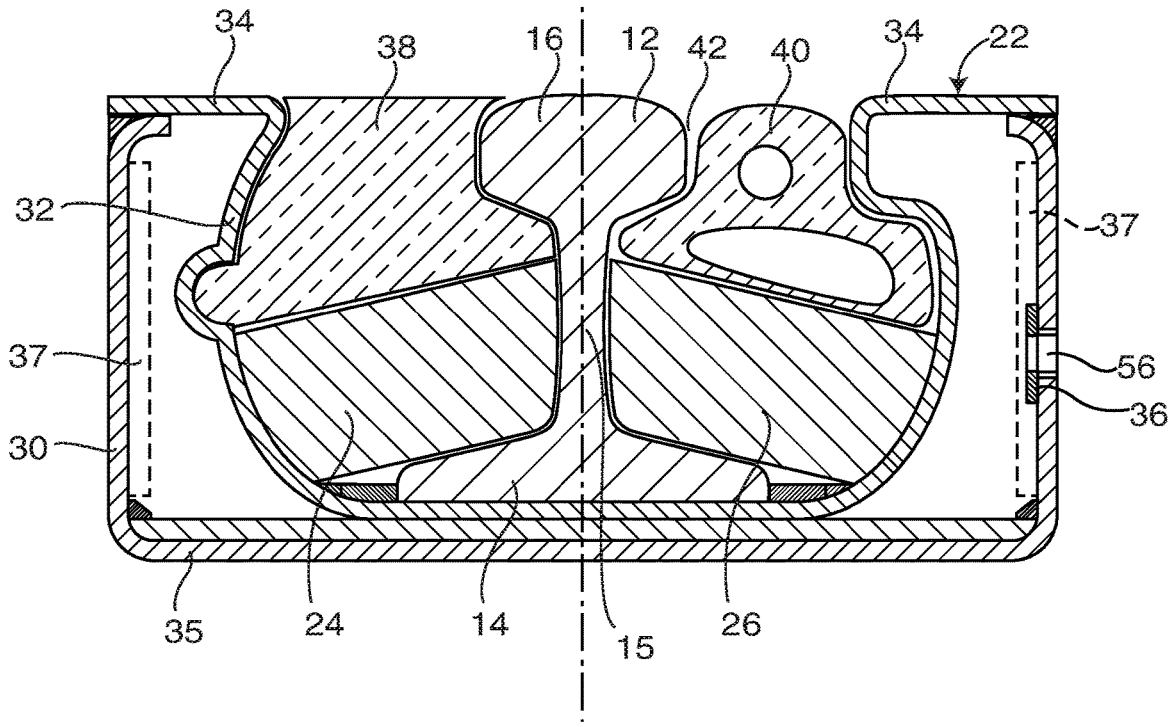
FIG. 1 shows a cross-sectional view of a trough unit and a rail of the invention.
Figure 2:
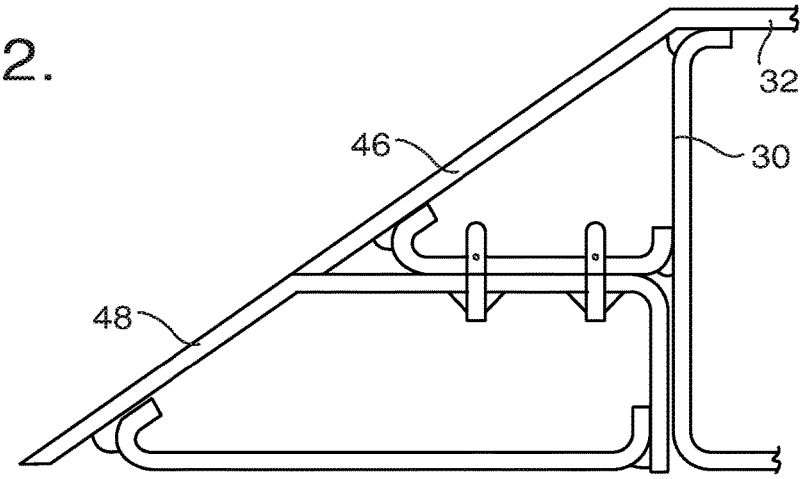
FIG. 2 shows a modification to part of the trough unit of FIG. 1.
Figure 4:
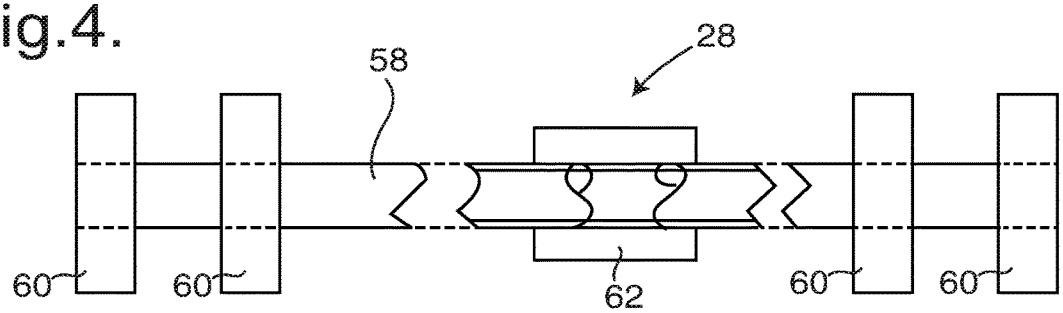
Figure 5A:
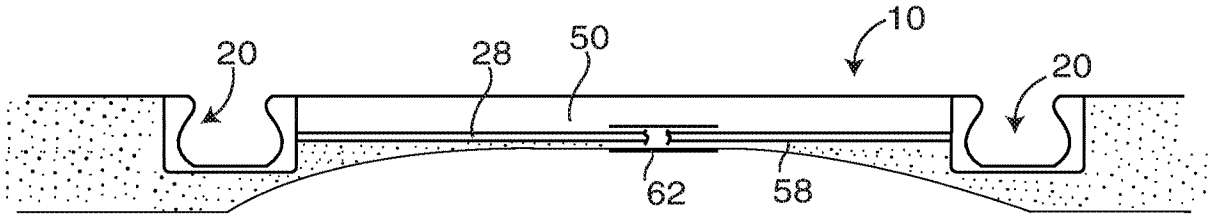
Figure 5B:
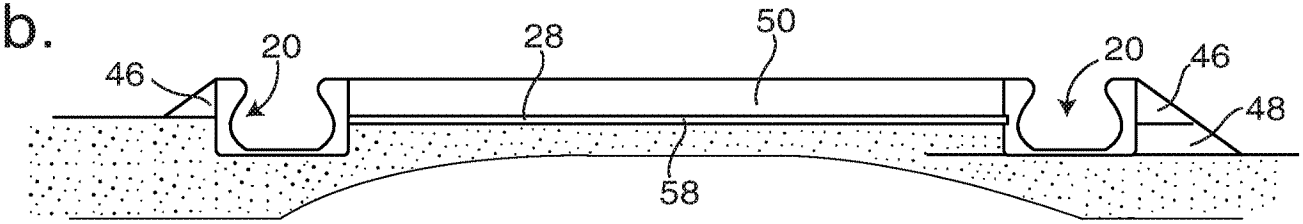
Figure 6:
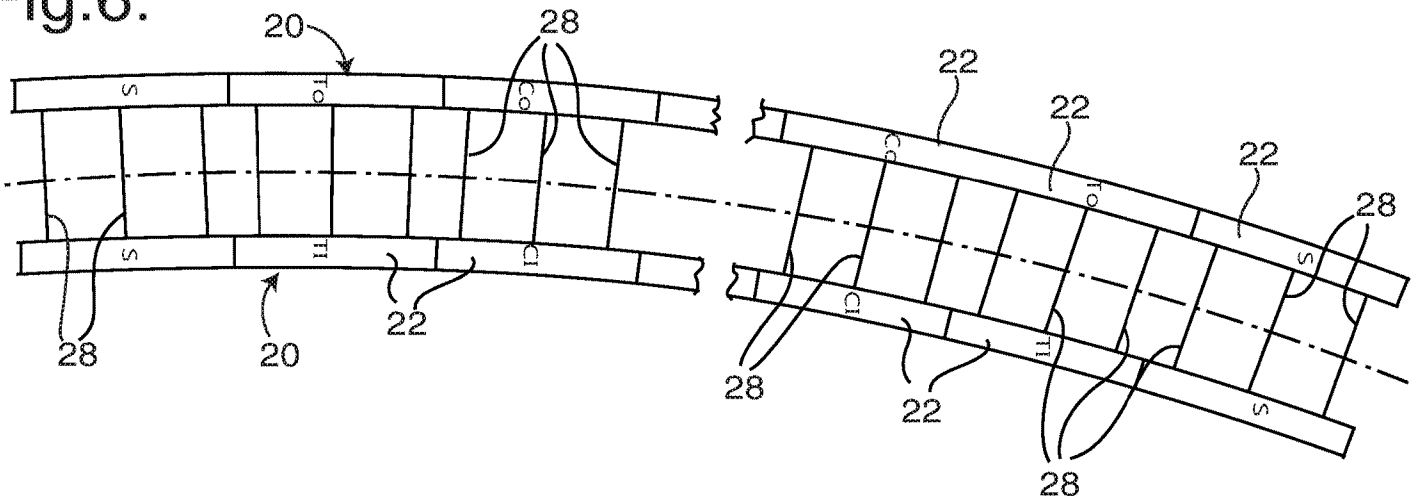
Figure 7:
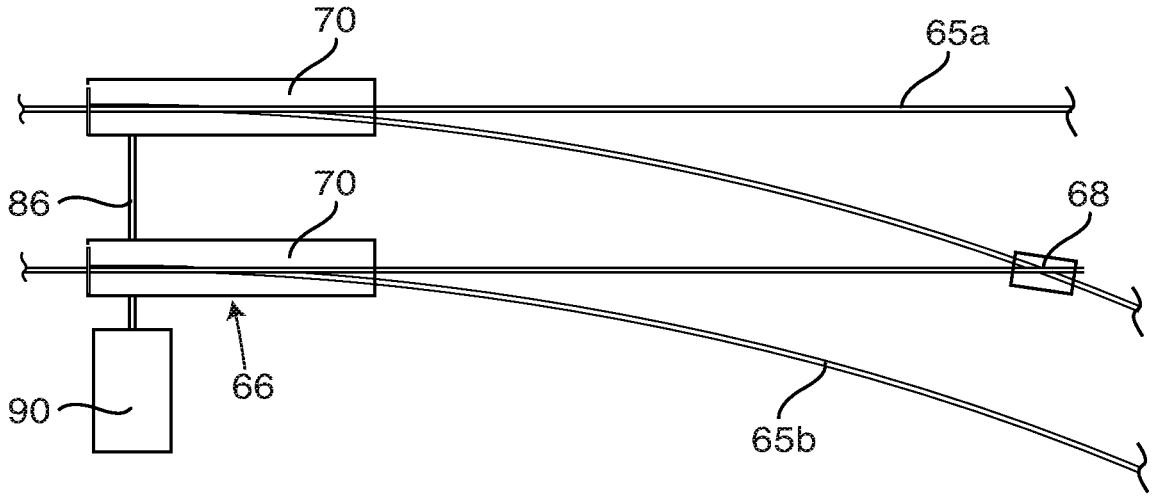
Figure 8:
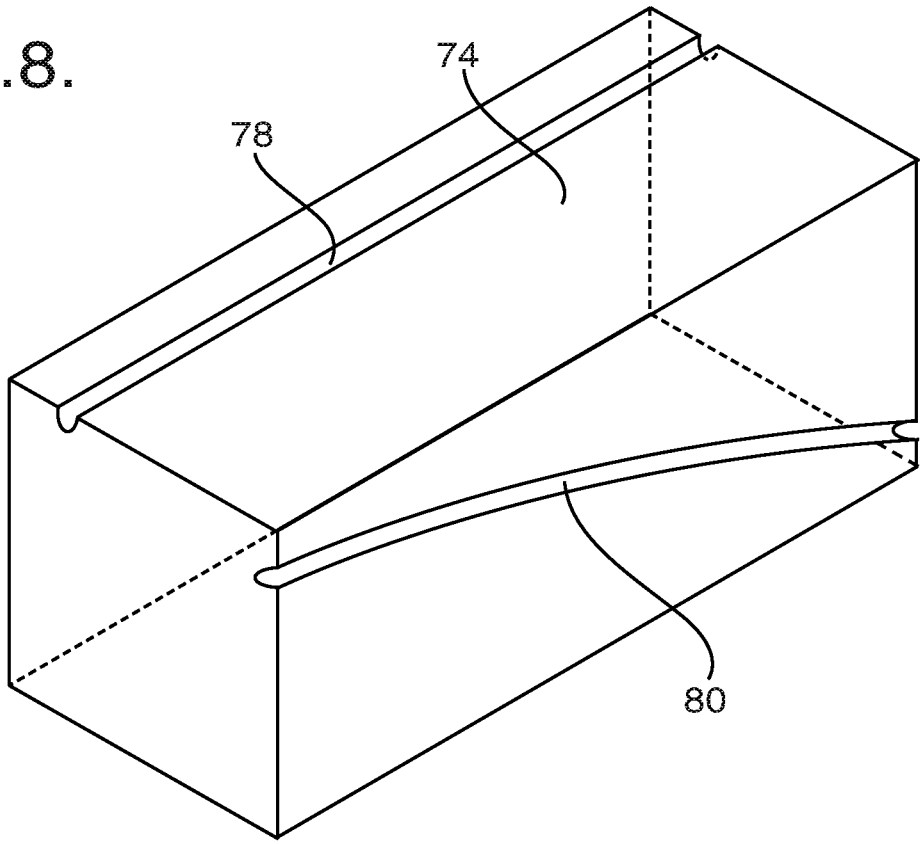
Figure 9:
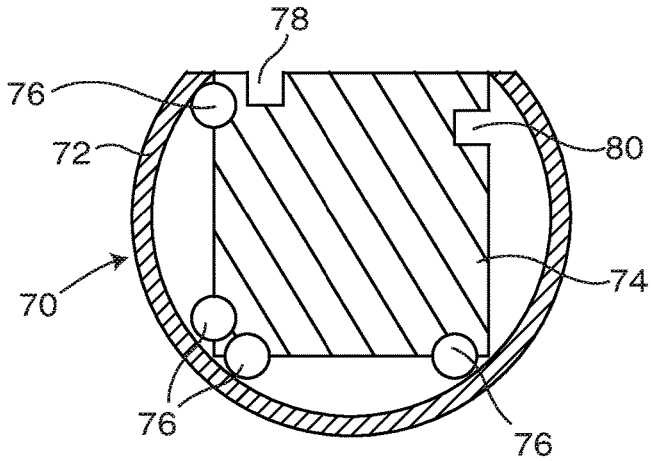
Figure 10A:
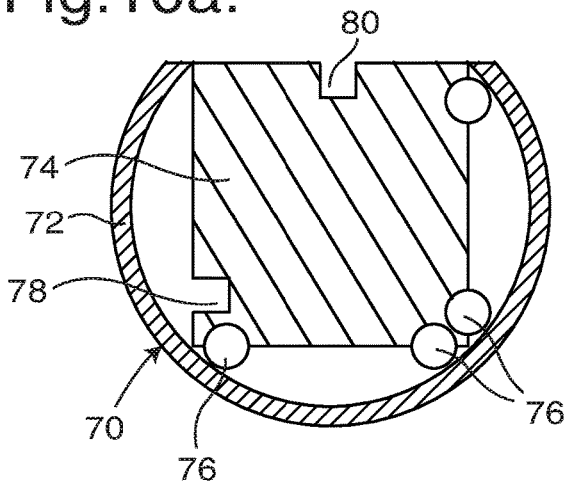
Figure 10B:
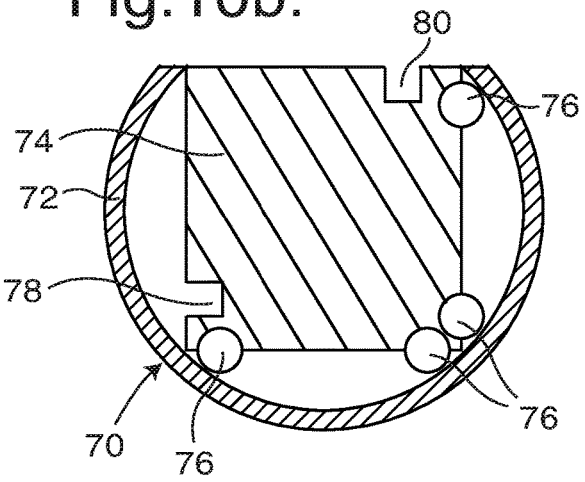
Figure 11A:
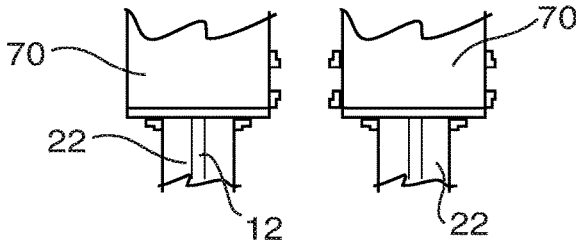
Figure 11B:
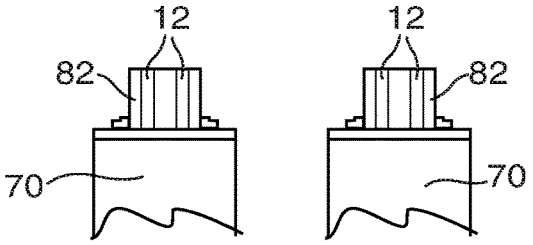
Figure 12:
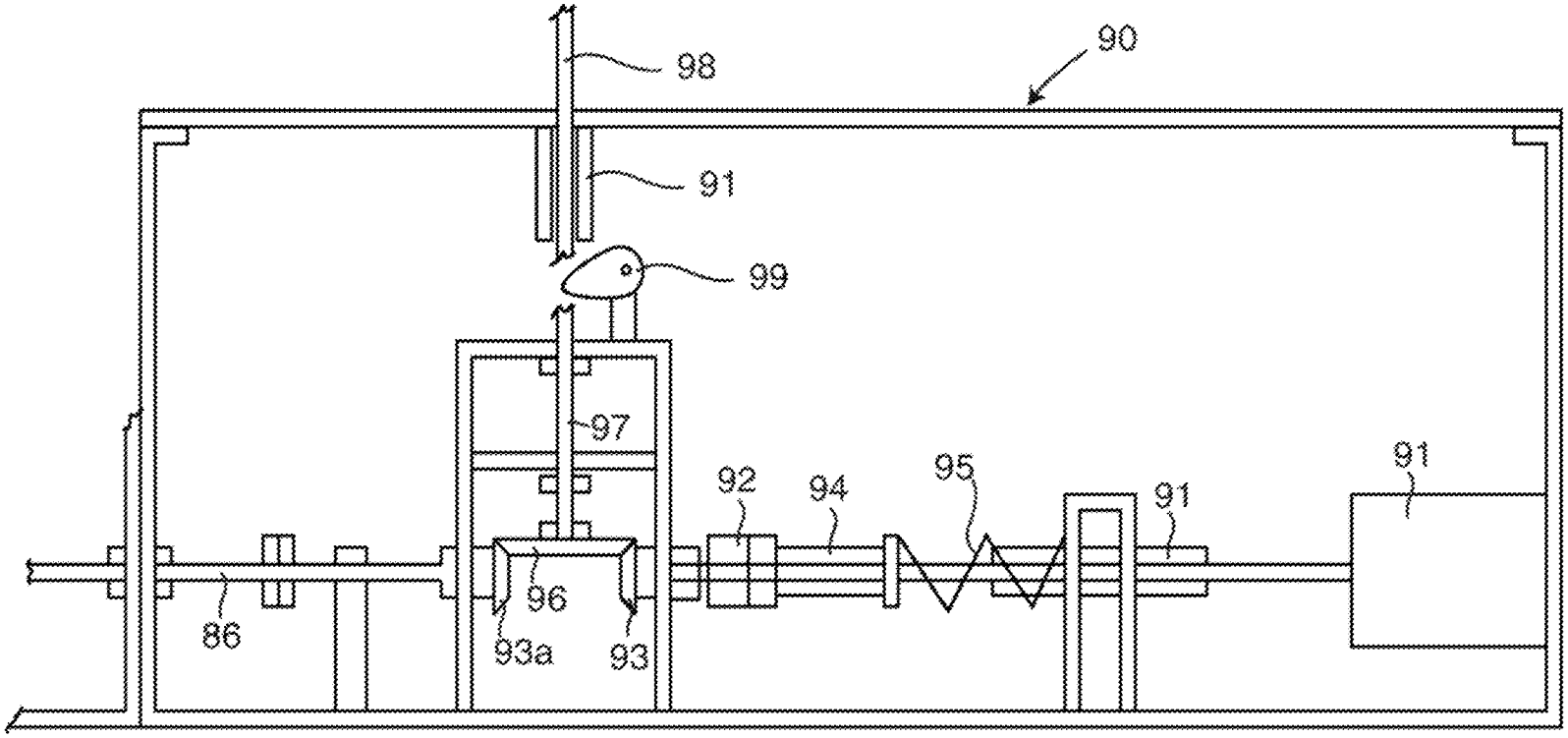
Figure 13:
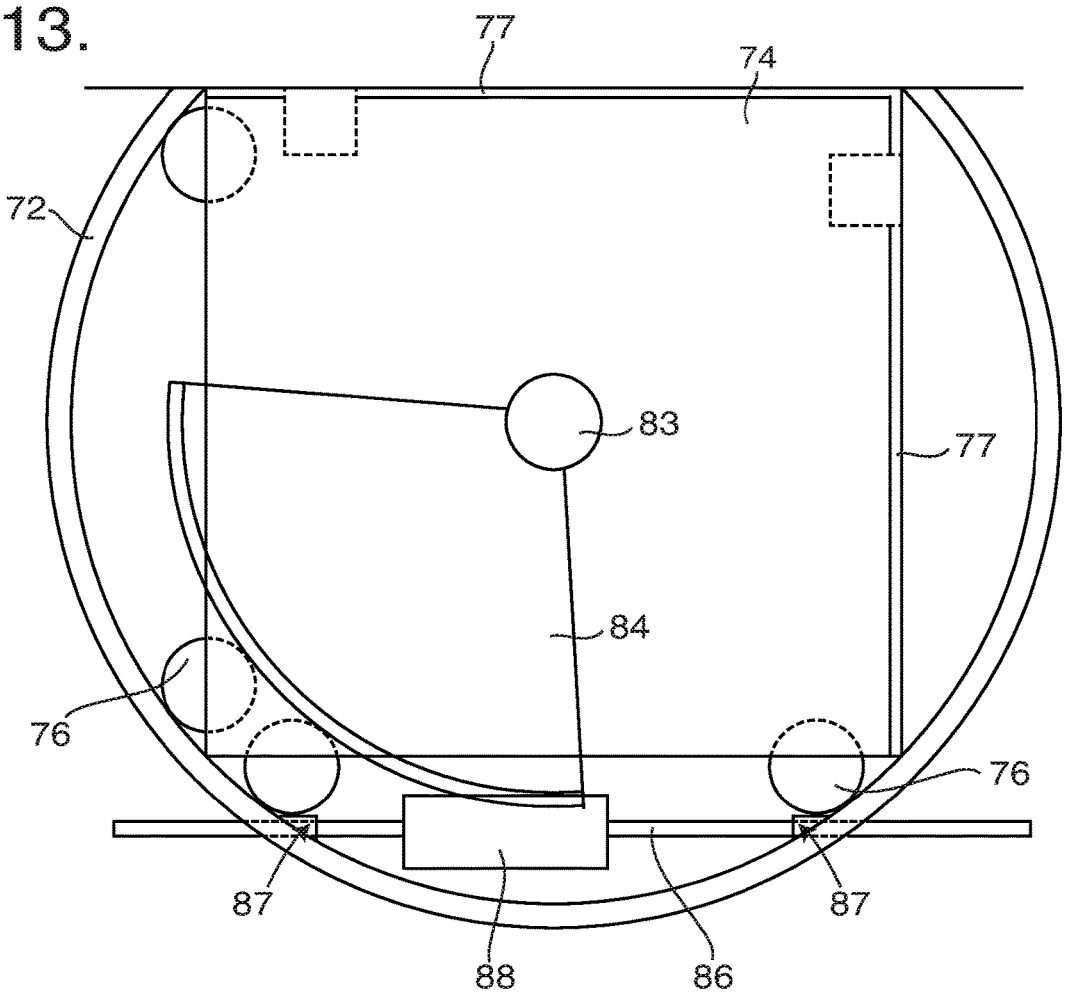
Figure 14:
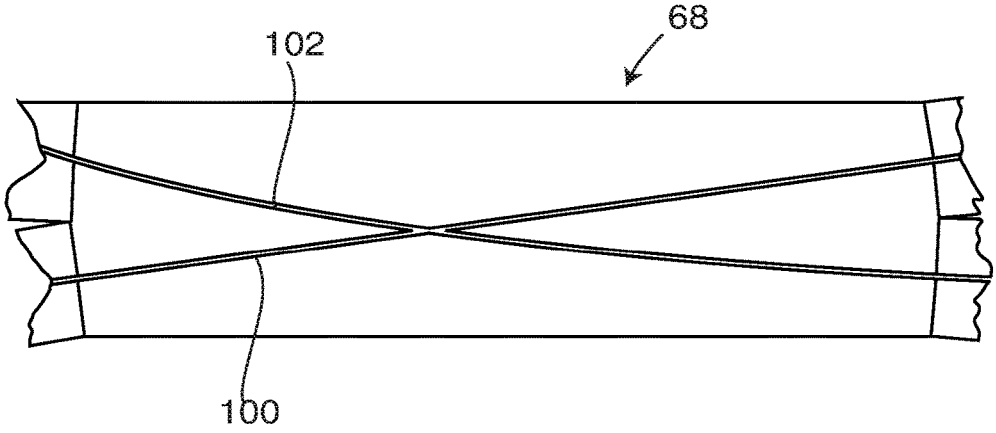

FIG. 4 shows a side view of a tie bar;

FIGS. 5*a* and 5*b* show two alternative arrangements of a trough structure that combines the trough units of FIG. 1 or 2 with the tie bar of FIG. 4;

FIG. 6 shows a plan view of trough structures of the invention where a track is curved;

FIG. 7 illustrates a turnout or points system of the invention;

FIG. 8 shows a perspective view of a beam which is incorporated in the points system of the invention;

FIG. 9 shows a cross-sectional view of the points system of the invention, in one setting;

FIGS. 10*a* and 10*b* show cross-sectional views of the points system of the invention at two different lengthwise positions, in a different setting;

FIGS. 11*a* and 11*b* show plan views of the two ends of the points system;

FIG. 12 shows a side internal view of the drive mechanism for the points system of the invention;

FIG. 13 shows an end view of the beam of the points system, showing part of the drive mechanism;

FIG. 14 shows a plan view of a frog device of the invention; and

Figure 15:
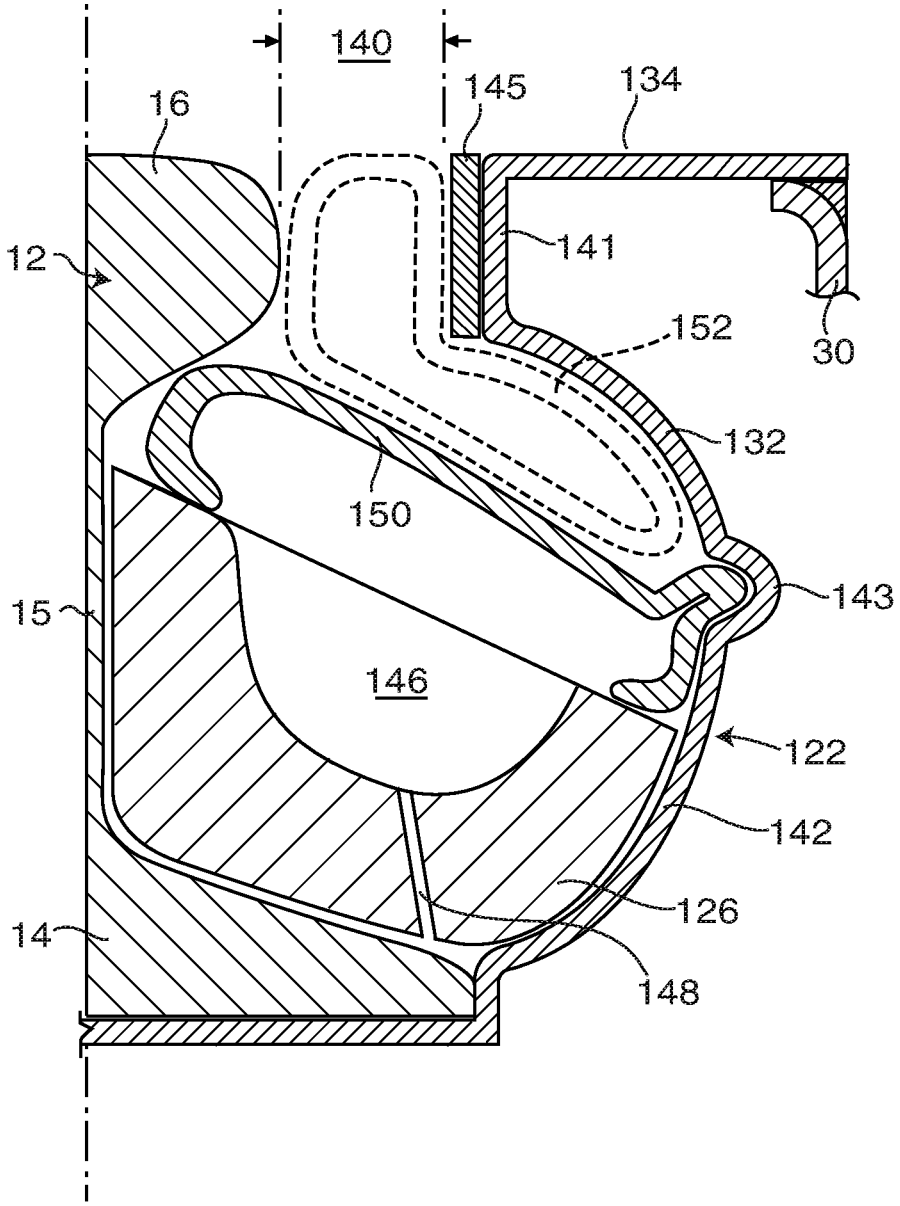

FIG. 15 shows a cross-sectional view of an alternative trough unit of the invention.

Referring now to FIGS. 1 and 5*a*, a light railway system 10 includes a track that comprises two parallel rails 12 (not shown in FIG. 5*a*), each rail having a base portion 14 with a flat bottom, an upward-extending web 15, and a railhead 16, for example having the vignole shape commonly used for railways. Each rail 12 rests within a respective trough structure 20 comprising multiple trough units 22 arranged end to end. As shown in FIG. 1 there are rigid blocks 24 and 26 that fit between the web 15 of the rail 12 and side portions of the trough unit 22 so as to locate the rail 12 within the trough structure 20. (Each of the blocks 24 and 26 fits up against a side of the web 15 and up against a side portion of the trough unit 22, so the rail 12 cannot move sideways or upwards relative to the trough unit 22; the rigid blocks 24 and 26 hence secure the rail 12 relative to the side portions of the trough units 22.) As shown in FIG. 5*a* there are multiple spaced-apart rigid ties 28 that interconnect the trough structures 20, to hold the trough structures 20 and so the rails 12 at a desired separation.

Referring now specifically to FIG. 1, each trough unit 22 comprises an outer generally-rectangular and open-topped first trough element 30, defining side walls and a base, and a second trough element 32 that defines a flat-bottomed recess to locate the rail 12 and the rigid blocks 24 and 26, and that defines edge flanges 34 welded to the top edges of the side walls of the first trough element 30, the base of the recess being supported by the base of the first trough element 30. The recess has side walls that are at least partly arcuate. The base of the first trough element 30 is reinforced with a horizontal plate 35 which extends the whole width of the base of the first trough element 30.

The rigid blocks 24 and 26 do not extend to the top of the recess, and there are resilient locking elements 38 and 40 that extend between the tops of the blocks 24 and 26 and the top of the recess. The arrangement in this example is such that the top surfaces of the edge flanges 34, and of the railhead 16, and of the resilient locking elements 38 and 40 are substantially in a common plane. In this example FIG. 1 shows the left-hand rail, and the block 26 is a gauge face block, while the block 24 is a key block. The block 26 would be installed first, and the key block 24 can then be inserted on the other side of the rail 12, first inserting the right-hand side of the block 24 to below the railhead 16, and then rotating the key block 24 so its outer end swings round adjacent to the arcuate wall of the recess, into the position as shown, without gaps (the gaps in the drawing along the bottom, side and top of the blocks 24 and 26 are only for clarity). The resilient locking elements 38 and 40 can then be inserted, and since they are resilient, they can be deformed during their insertion. The engagement of the locking elements 38 and 40 with the railhead 16 and the sidewall of the recess holds the rigid blocks 24 and 26 in place during the passage of rolling-stock along the rails 12.

Since this is the left-hand rail, there must however be a gap 42 between the right-hand side of the railhead 16 and the adjacent edge flange 34 to accommodate the tram wheel flanges when a tram passes along the track. In this example the resilient locking element 40 on that side of the railhead 16 is a compressible tube. As mentioned above, a conventional tram rail typically has a longitudinal groove to constrain the flange of the wheel, defined between the railhead and the side of an arm projecting from below the railhead on the gauge face side of the rail; that groove corresponds to the gap between the railhead 16 and the adjacent edge flange 34 of the trough unit 22, and that edge flange 34 may therefore be provided with a strip of hard-wearing material (not shown).

In the arrangement shown in FIG. 5*a* the trough structures 20 are arranged so their top edges are at ground level, so that for example the tram rails 12 would not project above the road surface. In the alternative arrangement shown in FIG. 5*b*, the base of the trough structures 20 are either on (see the right-hand side of FIG. 5*b*) or only half below the surface of the ground or road (see the left-hand side of FIG. 5*b*), and in this case, as illustrated in FIG. 2, a triangular box structure 46 is integral with one side of the trough structures 20. As illustrated here, there is a small triangular box 46 which is integral with the second trough element 32, and in addition there can be an extension 48 below the triangular box 46, so as to effectively form a large triangular box, for use if the trough structure 20 is resting on the road surface. These triangular boxes 46 or 48 act as ramps. As is evident in FIG. 5*b*, where the trough structures 20 extend above the ground or road surface either entirely or partially, the region between the two trough structures 20 would be infilled with a suitable infilling material 50, so that it would be possible for vehicles to cross the track. The in-filling material 50 may for example be loose material, paving slabs, paviours, or special-purpose panels.

Referring now to FIG. 3*a*, this shows a side view of the junction between two trough units 22 which are laid end to end. The end portions of each trough unit 22 include two spaced-apart horizontally-extending bearer strips 52 on the inside of the side walls, which are bevelled on their opposed surfaces. As shown in FIG. 3*b*, in which these bearer strips 52 are shown in broken lines, the gap between the edges becomes narrower going away from the side wall. A rectangular junction plate 54 whose edges have mating bevels is inserted between the bearer strips 52, holding the adjacent trough units 20 in alignment. To ensure the correct positioning of the junction plate 54, the bearer strips 52 are bevelled along most of their length, but there is a non-bevelled portion 55 further from the end of the trough unit, and this prevents the junction plate 54 going any further in than about half the length of the junction plate 54. Hence the junction plate 54 engages half its length with one trough unit 22 and the other half of its length with the adjacent trough unit 22.

Referring now to FIG. 4, the rigid ties 28 that interconnect the trough structures 20 comprise a bar or rod 58 with two spaced apart projections 60 shaped like the cross of a T at each end, and in the same plane, the two projections being spaced apart by a distance equal to the thickness of the side wall of the first trough element. As shown in FIG. 3*a* the side wall of each first trough element 30 defines a slot 56 through which the end projections 60 can be inserted, and the bar or rod 58 can then be turned through 90° so the two projections 60 engage with opposite faces of the side wall. That was considering only a single trough structure 20, but the rigid ties 28 must be connected to both trough structures 20, so in use the bar or rod 58 is inserted into a slot 56 at one side of the track, being inserted beyond the desired position, so it can then be inserted into a slot 56 at the opposite side of the track and partially withdrawn from the first slot 56, so when the rod 58 is turned through 90° the two pairs of projections 60 engage with both the trough structures 20.

The bar or rod 58 may be of a fixed length (as illustrated in FIG. 5*b*), and this is appropriate where the track is straight. Alternatively, as shown in FIG. 4, the bar or rod 58 includes a turnbuckle 62, the turnbuckle 62 having a left-hand thread at one end and a right-hand thread at the other end, engaging corresponding threads on end of the two halves of the rod 58. This is advantageous where adjustment to the gauge is required on sharp curves.

Each trough unit may for example be of length 2 m, and width 300 mm, and may be made of 6 mm thick steel plates. Where additional strength or load-bearing capacity is required, reinforcing plates may also be provided, for example the additional plate 35 at the base of the first trough element 30, and as also shown in FIG. 1 there may be a reinforcing plate 36 around the slot 56 in the side wall. As illustrated by broken lines on FIG. 1 there may also be web stiffeners 37 on each of the side walls. The separation of the rails is normally the standard gauge of 4' 8½"=56.5" (1435 mm), and this determines the length of the ties 28.

Where the track is required to follow a curve, slightly modified trough units 22 are used. Referring now to FIG. 6, which shows the arrangements of the trough units 22 where two straight portions of track are connected by a curve of nominal radius 25 m, it will be appreciated that the actual arc lengths are less on the inside of the curve than on the outside of the curve. In this example there are three different types of trough unit 22. Along the straight portion of track the trough units 22 on each side of the track are of equal lengths and are straight (marked S). There is then a transition towards a curve, for which the trough unit 22 on the inside is slightly shorter than that on the outside, and are slightly curved along their length (marked TI and TO for transition inner and transition outer respectively). And then in the curve, each trough unit 22 on the inside is shorter than that on the outside, and is curved along its length (marked CO and CI, for curve outer and curve inner respectively).

To allow for differential thermal expansion and contraction of the rail 12 and of the trough structure 20, there may be scarfed joints at intervals along the rail 12. These fit into the standard space for the rail 12 in the trough structure 20.

Where there is a junction between different tracks, a points or turnout mechanism is required. So for example in FIG. 7 there is a straight track 65*a*, and a curved track 65*b* branches off from it. This branch utilises a points mechanism 66 and a frog device 68. The points mechanism 66 includes two devices 70, one for each rail 12, which are operated simultaneously.

Referring to FIG. 9, each of the devices 70 includes a support tube 72 which extends horizontally, and is open along its top surface. Within the support tube 72 is a baulk or beam 74 of generally square cross-section, which is supported by four ceramic rollers 76 adjacent to three of its corners. In the position as shown, one face of the beam 74 occupies substantially the entire opening at the top of the support tube 72. The rollers 76 make it possible for the beam 74 to be rotated through an angle of 90° about the longitudinal axis of the support tube 72. Each device 70 may also include a trough unit otherwise referred to as a waybeam, which may be substantially equivalent to the trough unit 22 of FIG. 1, although it may be of a different width.

Referring now to FIG. 8, which shows a perspective view of the beam 74, the top face (as shown) defines a groove 78 that forms a flangeway from one end of the beam 74 to the other, in a straight line parallel to the longitudinal axis. An adjacent second face of the beam 74 defines a groove 80 forming a second flangeway from one end of the beam to the other, but which follows a curved path.

So referring again to FIG. 9, in this position of the beam 74 the groove 78 is on the upper, exposed face of the beam 74, and since the two devices 70 of the points mechanism 66 operate simultaneously, both the beams 74 are in this position, so the track is straight.

Referring now to FIGS. 10*a* and 10*b*, these show sectional views of a device 70 when the beam 74 has been rotated into its second position, with the groove 80 on the upper surface; the sectional views are at different distances along the device 70, FIG. 10*b* being further along the device 70 than FIG. 10*a*. The groove 80 is further to the right in FIG. 10*b*, as this view is taken close to the running-off end of the beam 74. At the running-on end of the beam 74 (i.e. the left-hand side in FIG. 7) both the straight groove 78 and the curved groove 80 are at the same distance from the edge of the beam 74, so at that end whichever face is uppermost, the groove 78 or 80 will be aligned (as a flangeway) with the rail 12 of the adjacent part of the track. Since the two devices 70 of the points mechanism 66 operate simultaneously, both the beams 74 are in this second position, so the track is curved.

As illustrated in FIG. 11*a*, at the running-on end, a trough unit 22 as described above connects to the end of the device 70, so the rail 12 as mentioned above aligns with the edge of the flangeway defined by the groove 78 or 80. As illustrated in FIG. 11*b*, at the running-off end there are special-purpose trough units 82 each carrying two spaced-apart rails, which align with either the groove 78 or the groove 80 at that end of the beam 74.

As schematically shown in FIG. 7, the points mechanism 66 incorporates a drive mechanism 90, arranged to turn both the beams 74 at the same time. Referring now to FIG. 13, which shows one end face of the beam 74 within the tube 72, a splined stub shaft 83 is inserted into a hole on the axis of the beam 74, and this stub shaft 83 carries a sector gear plate 84 which subtends an angle of 100°. Below the rollers 76 there is a driveshaft 86 which extends through bearings 87 on each side of the tube 72, and carries a worm drive 88 which engages the gear plate 84. The driveshaft 86 connects at one end to the drive mechanism 90, and connects to both the devices 70, so as to ensure that both beams 74 are always in the same orientation.

The beam 74 in this example is of an engineering plastic material, with hard-wearing metal plates 77 (shown in FIG. 13) on at least the faces that define the grooves 78 and 80 and so the flangeways.

Referring now to FIG. 12, the drive mechanism 90 comprises an electric motor 91 whose shaft extends through a tubular bearing 91 to a dog clutch 92, arranged to drive a bevel gear 93. The dog clutch 92 is held in contact by an energised solenoid 94 attached to a spring 95 in tension. The bevel gear 93 drives an idler gear 96 on a vertical axle 97, which itself drives a second bevel gear 93*a* which is connected to the drive shaft 86 for the worm drives 88. Hence the electric motor 91 can drive the worm drive 88 to turn the beams 74 through 90°. The rotational direction of the motor 91 is arranged to reverse at the end of each drive sequence.

Directly above and aligned with the vertical axle 97 is a tubular bearing 91 through which an emergency hand-operated shaft 98 can be inserted, the bottom end of the hand-operated shaft 98 having asymmetric splines to fit into corresponding slots at the top of the vertical axle 97. Immediately above the top end of the vertical axle 97 is a spring-loaded cam switch 99.

The power supply to the motor 91 and solenoid 94 is via the cam switch 99. Thus any interruption of the power supply either due to a failure of the mains or because of insertion by a tram driver of an emergency hand-operated shaft 98 results in the opening of the dog clutch 92 because of release of tension in the spring 95 attached to the solenoid 94. Hence in such an emergency the tram driver can operate the points manually.

Limit switches and pegs (not shown) prevent over-rotation of the beams 74, and activate the reversal of the motor's rotation. The pegs can be removed so that the beams 74 can be over-rotated by the hand-operated shaft 98 so as to expose the upper roller 76 which can then be withdrawn to allow the beam 74 to be lifted out of the supporting tube 72.

The frog device 68 is shown to a larger scale at FIG. 14, to which reference is now made. This may be of a similar structure to that of the beams 74, in that the frog device 68 may consist of a block or beam of solid material in whose surface are defined two grooves to act as flange ways, one groove 100 being straight and the other groove 102 being curved. This may be of a material such as an engineering plastic, covered with a sheet of hard-wearing material such as steel.

It will be appreciated that the above embodiments are given by way of example only, and that they may be amended in a variety of ways while remaining within the scope of the present invention as defined in the claims. For example the beams 74 of the points mechanism 66 may have a different cross-sectional shape, for example pentagonal or hexagonal, or may be partly cylindrical but with two flat faces.

Referring now specifically to FIG. 15, this shows a cross-sectional view of the right-hand side of an alternative trough unit 122; the left-hand side is as shown in FIG. 1, and identical features are referred to by the same reference numerals as previously. Each trough unit 122 comprises an outer generally-rectangular and open-topped first trough element 30 (only a fragment of which is shown), defining side walls and a base, and a second trough element 132 that defines a flat-bottomed recess to locate the rail 12 and rigid blocks 24 and 126, and that defines edge flanges 34 and 134 welded to the top edges of the side walls of the first trough element 30, the base of the recess being supported by the base of the first trough element 30 (the block 24 and the edge flange 34 are shown in FIG. 1). There may also be stiffening plates or load-spreading plates (not shown).

The right-hand side wall of the recess has at the top a vertical part 141 coming down from the edge flange 134, below which there is an arcuate part 142, with a notch 143 at about half the height of the second trough element 132. The vertical part 141 is covered with a wear strip 145 of hard-wearing material. There may also be shims (not shown) below the foot 14 of the rail 12. There is a rigid block 126 that engages the web 15, the foot 14 and the lower part of the arcuate side wall part 142 without gaps (the gaps between these items in the drawing are only for clarity).

The gap 140 between the railhead 16 and the wear strip 145 is of such a width as to accommodate a flange of a tram wheel. In order to make insertion of the rigid block 126 through that gap 142 easier, the block 142 defines a hollowed-out part 146 along its upper surface. The block 126 can therefore be inserted through the gap 140 and then swung down into the position as shown. The rigid block 126 also defines a drain hole 148 to drain out any liquids that enter through the gap 140.

The rigid block 126 is secured in the position as shown by a steel spring clip 150, one end of which engages the notch 143 and the top of the block 126, and the other end of which engages the underside of the railhead 16 and the top of the block 126. The width of the clip 150 may for example be 1 cm or 2 cm. This clip 150 can be inserted through the gap 140 (with its length parallel to the longitudinal axis of the rail 12), and then rotated through a vertical axis through 90°, first locating the one end in the notch 143 and then deforming the clip 150 into engagement with the underside of the railhead 16 as shown. There is preferably at least one clip 150 for each rigid block 126; such a clip 150 may be provided at intervals of for example 0.3 m if the rigid blocks 126 are longer than that, or at intervals of say 0.75 m if the blocks 126 are longer than that.

To inhibit materials falling through the gap 140 into the recesses, a resilient tube 152 (shown in broken lines) is preferably located in the recess, above the spring clip 150. This is shaped such that the top surfaces of the edge flanges 34 and 134, and of the railhead 16, and of the resilient locking element 38 and the resilient tube 152 are substantially in a common plane. As with the embodiment of FIG. 1, FIG. 15 shows the left-hand rail 12, and the block 126 is a gauge face block, while the block 24 is a key block. The block 126 would be installed first, and the key block 24 can then be inserted on the other side of the rail 12 as described above.

What is claimed:

1. A light railway system comprising two parallel rails, and two separate trough structures, one for each rail, each rail having a base portion with a flat bottom, an upward-extending web, and a railhead, and resting within a respective trough structure, each trough structure comprising multiple trough units arranged end to end, with rigid blocks that fit and extend between the web of the rail and side portions of the trough unit so as to locate the rail within the trough structure, wherein each trough unit comprises an outer generally-rectangular and open-topped first trough element, defining side walls and a base, and a second trough element that defines a recess to locate the rail and the blocks, and that defines edge flanges fixed to the top edges of the side walls of the first trough element, the base of the recess being supported by the base of the first trough element, and the system also including multiple spaced-apart rigid ties that interconnect the trough structures, to hold the trough structures at a desired separation, so the rails are at a desired separation.

2. A system as claimed in claim 1 wherein the recess has side walls that are at least partly arcuate.

3. A system as claimed in claim 1 wherein the blocks do not extend to the top of the recess, and resilient locking elements are inserted into the recess, and extend between the tops of the blocks and the top of the recess.

4. A system as claimed in claim 3 arranged such that the top surfaces of the edge flanges, and of the rail, and of the resilient locking elements are substantially in a common plane.

5. A system as claimed in claim 1 wherein at least one of the blocks, and an adjacent side wall of a trough unit, are shaped such that the said block can be rotated into position.

6. A system as claimed in claim 1 wherein each end of each trough unit is linked to the next trough unit by one or more projecting elements and mating recesses, so the successive trough units are held securely in alignment with each other.

7. A system as claimed in claim 6 wherein the trough units have side walls and the side walls each incorporate two parallel spaced-apart bearer strips whose opposed edges are bevelled so the gap between the edges becomes narrower going away from the side wall; and the system comprises rectangular junction plates whose edges have mating bevels, so the junction plates can be inserted between the bearer strips on the adjacent trough units, to hold the adjacent trough units in alignment.

8. A system as claimed in claim 1 wherein the trough units have side walls, and the rigid ties that interconnect the trough structures comprise a bar or rod with two spaced apart projections at each end, the two projections being spaced apart by a distance equal to the thickness of the side wall of the trough unit, and at least the projection nearest the end of the bar or rod being shaped like the cross of a T, and wherein the side wall of each trough unit defines a slot through which the end projection can be inserted.

9. A system as claimed in claim 8 wherein both the projections are shaped like the cross of a T, and are in the same plane.

10. A system as claimed in claim 1 also comprising a turnout or points mechanism, the mechanism comprising two generally horizontal cylindrical support tubes, each open along an upper face, and each locating a beam having at least two faces, and supported by bearings within the support tube such that a first face of the beam may be exposed at the open upper face of the support tube, the bearings enabling the beam to be turned around its longitudinal axis so as to expose a second face, wherein the first face of the beam defines a groove forming a first flangeway from one end of the beam to the other, and the second face of the beam defines a groove forming a second flangeway from one end of the beam to the other.

11. A system as claimed in claim 10 wherein the beam is of a solid material, with a hard-wearing metal plate on at least the faces that define the flangeways.

12. A system as claimed in claim 10 also comprising a drive mechanism, arranged to turn both the beams at the same time.

13. A system as claimed in claim 12 wherein the drive mechanism for each beam incorporates a sector gear plate connected to the beam, and engaging a worm drive.

14. A system as claimed in claim 12 wherein the drive mechanism incorporates an electric motor, and also comprises a manual drive.

15. A system as claimed in claim 10 also comprising a frog device that consists of a beam one face of which defines two grooves acting as flangeways, which intersect to form an X.

16. A system as claimed in claim 1 wherein the trough units are made of steel plates.

* * * * *